US006856232B2

(12) United States Patent
Chen

(10) Patent No.: US 6,856,232 B2
(45) Date of Patent: Feb. 15, 2005

(54) MOUNTING FIXTURE FOR SWITCH CONNECTORS

(76) Inventor: Wen-Pin Chen, No. 1-7, Lane 251, Te Shan Rd., Jen-Te Hsiang, Tainan Hsien (TW)

( * ) Notice: Subject to any disclaimer, the term of this patent is extended or adjusted under 35 U.S.C. 154(b) by 0 days.

(21) Appl. No.: 10/427,952

(22) Filed: May 2, 2003

(65) Prior Publication Data

US 2004/0217842 A1 Nov. 4, 2004

(51) Int. Cl.[7] ..... H01H 37/04; H01H 37/02

(52) U.S. Cl. ..... 337/187; 337/188; 337/113; 337/59; 337/66; 439/441

(58) Field of Search ..... 337/59, 34, 66, 337/97, 112, 113, 187, 188, 381, 383, 399; 439/441

(56) References Cited

U.S. PATENT DOCUMENTS

| | | | | | |
|---|---|---|---|---|---|
| 2,720,634 | A | * | 10/1955 | Hart | 439/441 |
| 4,894,023 | A | * | 1/1990 | Hall | 439/278 |
| 4,978,315 | A | * | 12/1990 | Edgley et al. | 439/441 |
| 5,098,317 | A | * | 3/1992 | Lau | 439/729 |
| 5,292,260 | A | * | 3/1994 | Sinisi et al. | 439/441 |
| 5,445,528 | A | * | 8/1995 | Frantz | 439/79 |
| 5,494,456 | A | * | 2/1996 | Kozel et al. | 439/441 |
| 5,599,201 | A | * | 2/1997 | Sommer et al. | 439/441 |
| 5,750,947 | A | * | 5/1998 | Rao et al. | 200/6 R |
| 5,876,237 | A | * | 3/1999 | Patel et al. | 439/441 |
| 6,056,585 | A | * | 5/2000 | Hatakeyama et al. | 439/441 |
| 6,280,233 | B1 | * | 8/2001 | Beege et al. | 439/441 |
| 6,336,824 | B1 | * | 1/2002 | Sorig | 439/441 |
| 6,428,343 | B1 | * | 8/2002 | Landis et al. | 439/441 |
| 6,570,306 | B2 | * | 5/2003 | Henrici et al. | 313/318.01 |
| 6,682,364 | B2 | * | 1/2004 | Cisey | 439/441 |
| 6,712,641 | B2 | * | 3/2004 | Beege et al. | 439/441 |

FOREIGN PATENT DOCUMENTS

JP 01130480 A * 5/1989 ..... H01R/4/48

* cited by examiner

*Primary Examiner*—Anatoly Vortman
(74) *Attorney, Agent, or Firm*—Dennison, Schultz, Dougherty & MacDonald

(57) ABSTRACT

A mounting fixture for fast installation of switch connectors is provided. The mounting fixture is encased in a molded housing with a plurality of dividers separating an interior of the housing into a plurality of compartments. An elongated pin is adjacent to one end wall of the housing for receiving the metal pin of the connector and an elongated anchor slot is adjacent to another end wall for anchoring a metal inlay in each compartment. Each metal inlay is formed with two orthogonal planes, an anchor plate and a resilient plate. The resilient plate has a notch on the far edge, such that when the copper wires of the electric cable are inserted into the mounting fixture through the wire hole, the notch will be able to clamp on the inserted wires by the counter force from the resilient plate.

5 Claims, 8 Drawing Sheets

MOUNTING FIXTURE FOR SWITCH CONNECTORS

BACKGROUND OF THE INVENTION

1. Field of the Invention

The present invention relates to a mounting fixture for switch connectors, in particular to a mechanical design of the mounting fixture that is able to facilitate the installation of switch connectors for improved productivity.

2. Description of Related Arts

Switches and plugs are normally used for making the electrical connection to electrical appliances and electronic devices. In general, switch connectors have at least two metal conductors extending from the molded connector casing leading to an electrical cable, the connector casing has a switch for controlling the electrical connection between the power line and the electrical appliance. The copper wires exposed from the stripped electric cable are usually soldered on to the metal conductors of the switch connector to make the necessary electrical connection. Another way of attaching the wires is by winding them around a fixing screw and then tightening the screw set on the metal conductor to secure the connection.

The above-mentioned methods of making electrical connection, by way of either solder or screws, require some kinds of tools such as a soldering gun or a screwdriver to accomplish the task, which is not very bandy. The operations take a considerable amount of time as the contacts are rather small and in a restricted space. It is therefore difficult to improve the productivity in the installation of electrical connectors.

SUMMARY OF THE INVENTION

The main object of the present invention is to provide a mounting fixture for fast installation of switch connectors for the necessary electrical installation.

The mounting fixture in accordance with the present invention includes a housing, with a plurality of dividers separating an interior of the housing into compartments.

A plate slot is formed adjacent to one side of one divider for receiving metal plates from the switch connector, and an elongated anchor slot is defined in the other side of the divider for anchoring a metal inlay.

Each compartment has a wire hole allowing strand copper wires to be inserted from outside. Each compartment securely receives one of the metal inlays having two planes orthogonal to each other, forming an anchor plate and a resilient plate.

The resilient plate has a notch on a distal edge, such that when a respective one of the copper wires from the electric cable is inserted through the wire hole, the wire will push the partially overlapping resilient plate to bend outward, and when the pressure is released, the resilient plate will bounce back and clamp on the copper wire to hold the wire firmly in place. Thus, the copper wires can be inserted through the wire holes by hand without need for tools.

The mounting fixture according to the present invention enables fast installation of switch connectors, thus improving the productivity in the connector assembly.

The features and structure of the present invention will be more clearly understood when taken in conjunction with the accompanying drawings.

DETAILED DESCRIPTION OF THE PREFERRED EMBODIMENT

Figure 1:
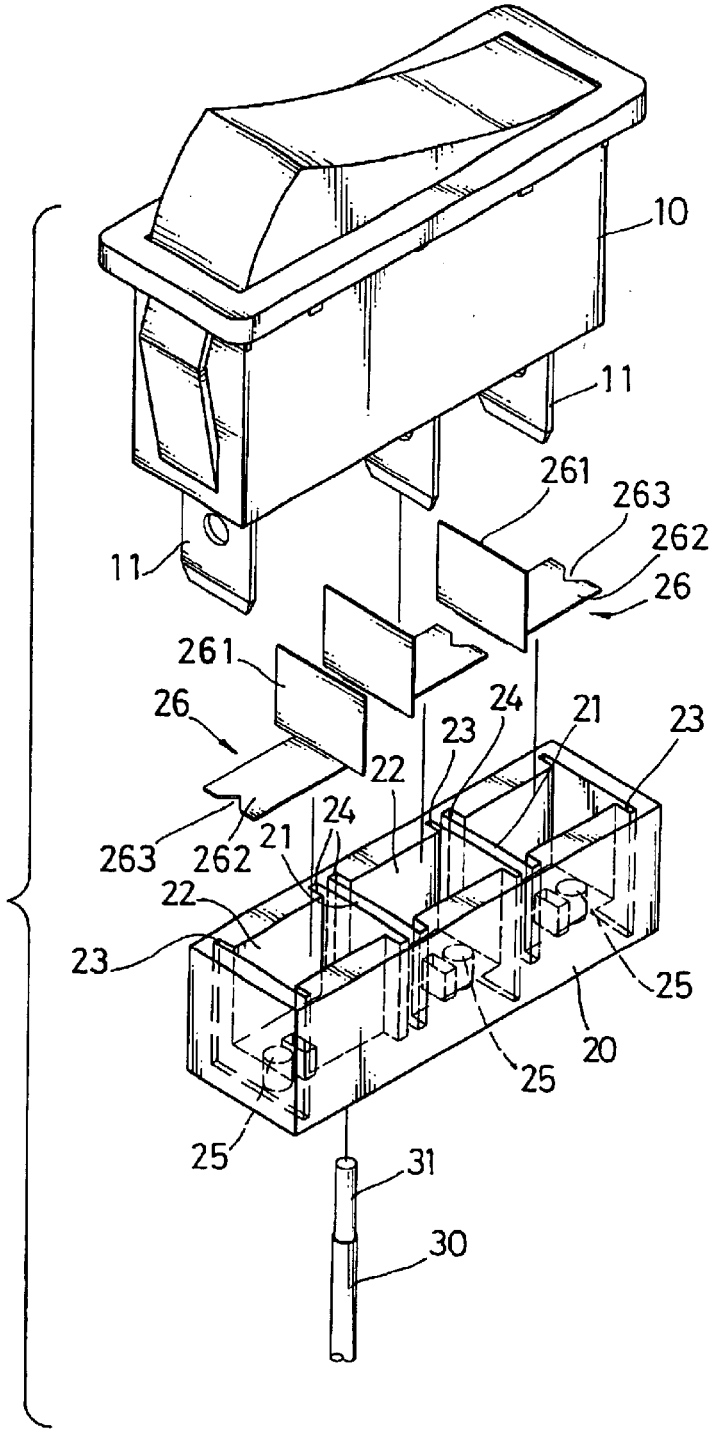
FIG. 1 is an exploded diagram of the overall structure of the connector and the mounting fixture.

The present invention provides a mounting fixture for fast installation of switch connectors as shown in FIG. 1.

The mounting fixture is embedded in a housing (20) formed as an open box and containing a plurality of compartments (22) separated by dividers (21). Each compartment (22) securely receives a metal inlay (26) for clamping copper wires (31) protruding from the stripped electric cable (30) to be inserted from outside.

A plate slot (23) is formed adjacent to a first end wall of the compartment (22) for receiving a metal plate (11) of the switch connector (10), and an anchor slot (24) is formed adjacent to a second end wall opposite the first end wall for anchoring the metal inlay (26).

Each compartment (22) has a wire hole (25) extending through a bottom wall of the housing (20) for receiving a respective one of the copper wires (31) to be inserted from outside.

Figure 2:
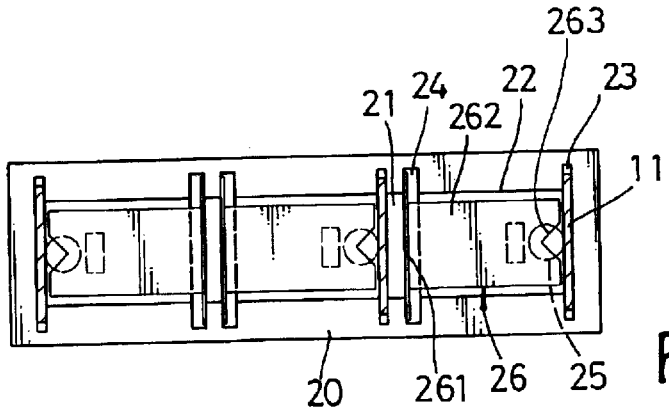
FIG. 2 is the cross-sectional and top view of the mounting fixture in accordance with the first embodiment of the invention.

The metal inlay (26) inserted into each compartment (22) is press-formed with two orthogonal planes, forming an anchor plate (261) and a resilient plate (262) respectively disposed on two sides of the metal inlay (26). As shown in FIG. 2, the resilient plate (262) has a notch (263) on a distal edge, and the width of the anchor plate (261) is greater than that of the resilient plate (262). The anchor plate (261) is used for anchoring the end of the metal inlay (26). The resilient plate (262) is anchored in the compartment (22) for receiving the copper wires (31) from the stripped electric cable (30), such that the notch (263) partially overlaps a portion of the opening of the wire hole (25).

Figure 3:
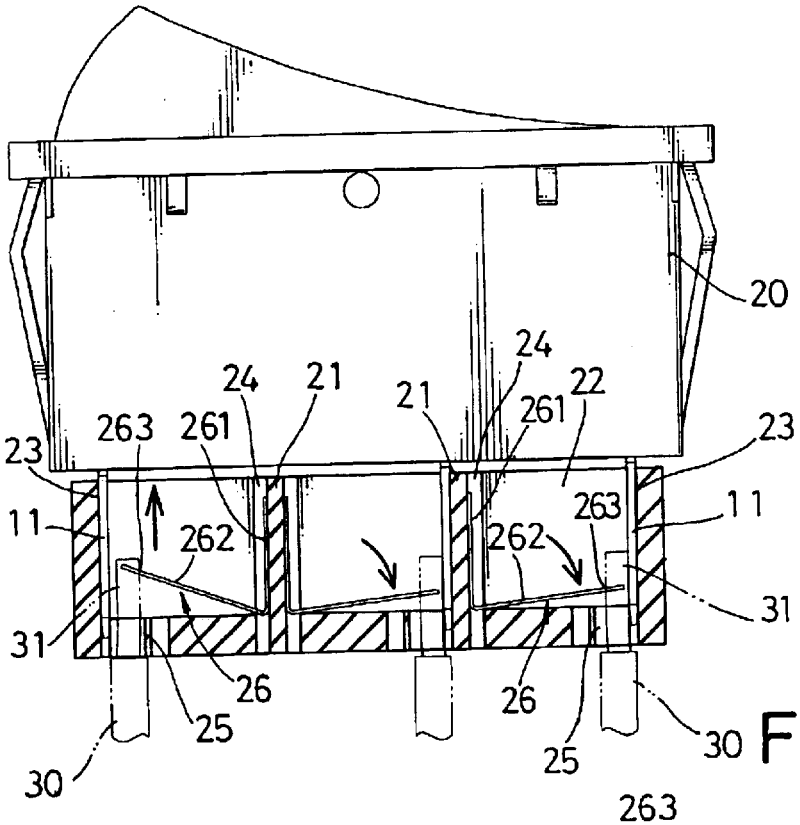
FIG. 3 is a side view of the assembly of the connector in accordance with the first embodiment of the invention.

During assembly of the connector (10), as shown in FIG. 3, when the copper wires (31) of the stripped electric cable (30) are inserted through the wire hole (25) into a respective one of the compartments (22), the copper wires (31) will nudge against the resilient plate (262) partially covering the wire hole (25), forcing the resilient plate (262) to flex in the direction of the anchor plate (261). A counter force is generated when the resilient plate (262) is pushed towards the orthogonal anchor plate (261). When the incoming pressure is released due to the copper wire (31) having been extended a sufficient length into the housing (20), the resilient plate (262) will bounce back causing the inner edge defining the notch (263) to clamp on the copper wire (31) around the wire hole (25).

This mechanical force from the resilient plate (262) is able to hold the copper wire (31) firmly around the notch (263) and press it towards the metal plate (11) from the connectors (10) for the necessary electrical connection. The metal plate (11) is inserted into the plate slot (23) next to the wire hole (25). Any force to pull out the copper wires (31) will only result in tightening of the grip around the copper wires by the counter force of the resilient plate (262) around the notch (263). The mechanical structure of the mounting fixture thus is able to accomplish the goal of holding down the copper wires for making the necessary electrical connection, without any risks of the copper wires (31) escaping the compartments (22).

Figure 4:
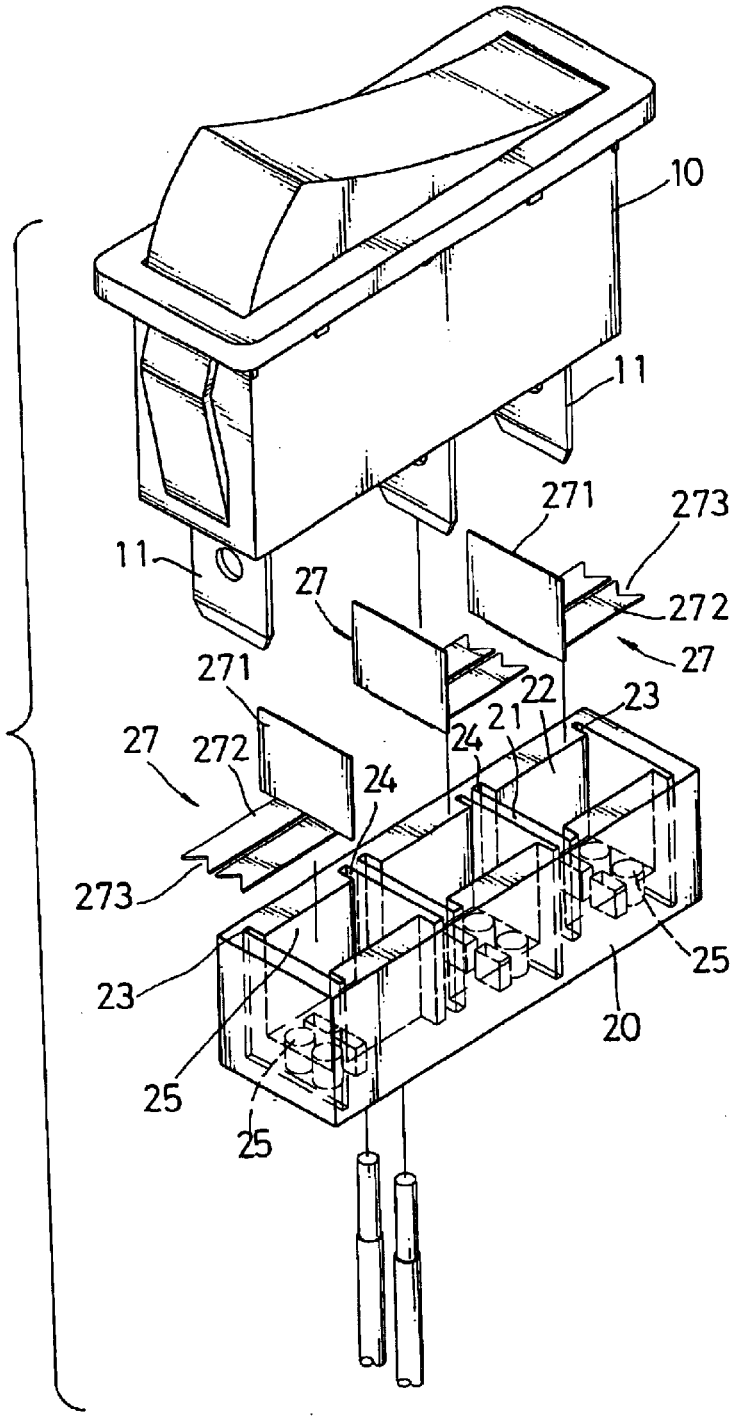
FIG. 4 is an exploded diagram of the connector assembly in accordance with the second embodiment of the invention.

An exploded diagram of the structure of the second embodiment of the invention is shown in FIG. 4. The housing (20) for the mounting fixture is the same as that previously used. The housing is a formed like an open box with a plurality of compartments (22) separated by dividers (21). Each compartment (22) receives a metal inlay (27) for clamping down copper wires (31) to be inserted from outside.

A plate slot (23) is formed adjacent to one end wall of the compartment (22) for receiving the metal plate (11) of the connectors (10), and an anchor slot (24) is formed adjacent to the opposite end wall. The compartment (22) also has a wire hole (25) to allow a copper wire (31) to extend through the bottom wall of the housing (20) from outside.

Figure 5:
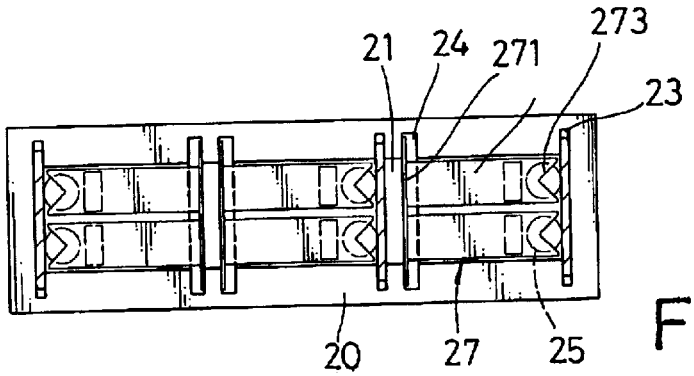
FIG. 5 is the cross-sectional and top view of the mounting fixture in accordance with the second embodiment of the invention.

The metal inlay (27) is press-formed to create two planes, orthogonal to each other, forming an anchor plate (271) on one side and more than one resilient plate (272) on the other side forming multi-prongs. As shown in FIG. 5, each resilient plate (272) has a notch (273) on the far edge, and the width of the anchor plate (271) is greater than that of the total width of the combined resilient plates (272). The anchor plate (271) is used for anchoring the metal inlay (27) to be placed in the compartments (22). The multi-pronged resilient plates (272) are placed in tandem in the compartment (22), such that each notch (273) corresponds to a respective wire hole (25), and each notch (273) partially overlaps the opening of the respective wire hole (25).

Figure 6:
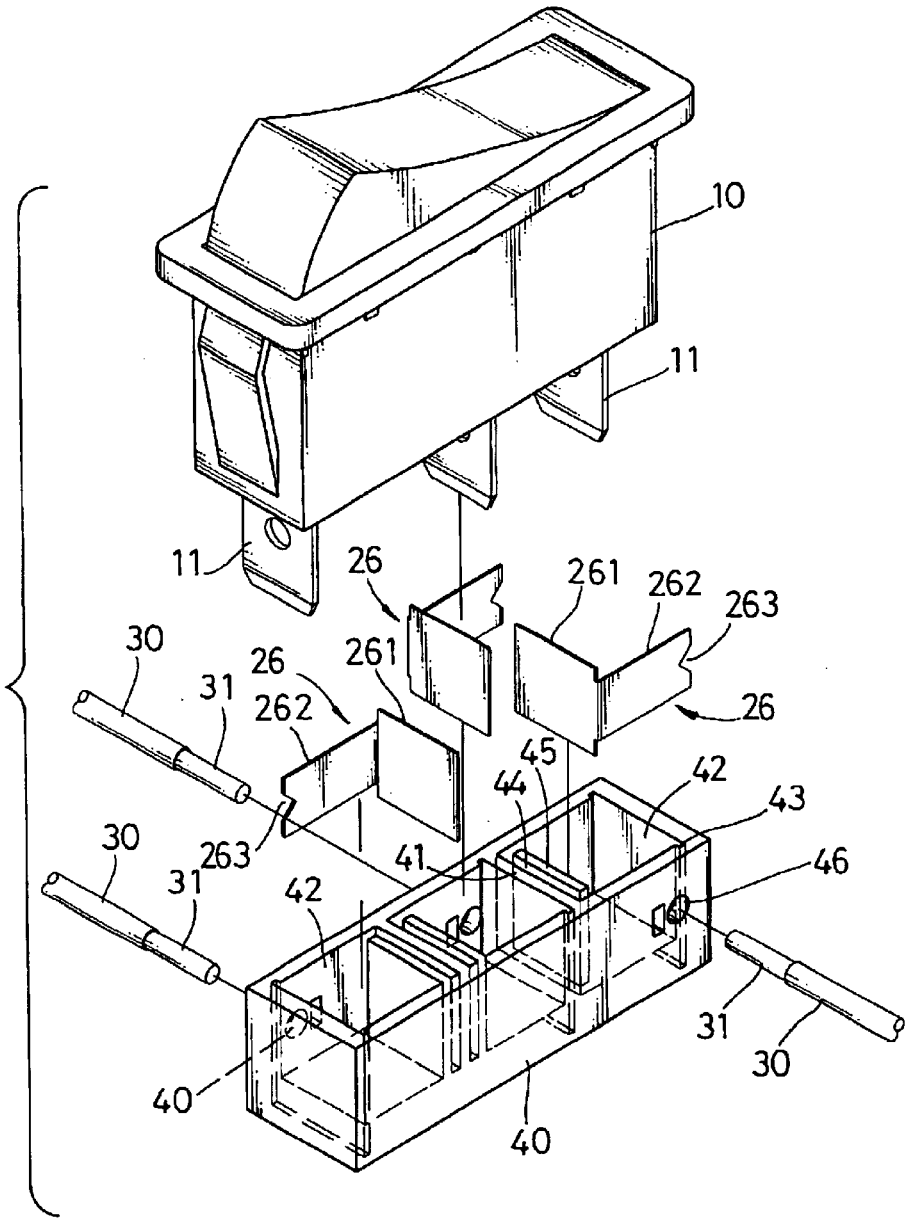
FIG. 6 is an exploded diagram of the connector assembly in accordance with the third embodiment of the invention.
Figure 7:
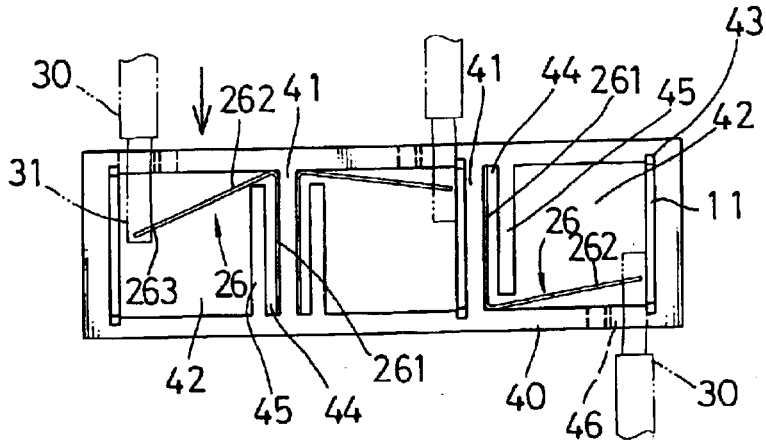
FIG. 7 is a side view of the mounting fixture in accordance with the third embodiment of the invention.

During assembling of the connector (10), as shown in FIG. 6, when the copper wires (31) from the stripped electric cable (30) are inserted through the wire hole (25) passing through the bottom wall of the compartment (22), the copper wires will nudge against the respective resilient plate (272) forcing it to flex in the direction of the anchor plate (271). A counter force is generated when the resilient plate (272) is pressed towards the anchor plate (271). When the incoming pressure of the wires on the resilient plate (272) is eventually released, the resilient plate (272) will spring back and the inner edge of the notch (273) will clamp on the copper wires (31) around the wire hole (25) to hold them in place and push them towards the metal plate (11) from the connector (10) disposed in the plate slot (23) next to the wire hole (25).

Any force to pull out the copper wires (31) will only result in tightening of the grip around the copper wires by the counter force of the resilient plate (272).

An exploded diagram of the structure of a third embodiment of the invention is shown in FIG. 6. The structure of the housing (40) is formed as an open box with a plurality of compartments (42) separated by dividers (41). Each compartment (42) receives a metal inlay (26) used for clamping the copper wires (31) of the stripped electric cable (30). The main distinction of the third embodiment with the previously described implementations is that a second divider (45) is used to secure the anchor slot (44), and the wire hole (46) is formed in the lateral side of the housing (40) instead of the bottom wall. The anchor slot (44) is used for anchoring the end of the metal inlay (26) with the anchor plate (261). The metal inlay (26) is aligned with the wire hole (46) such that the axis running through the opening of the wire hole (46) is orthogonal to the plane of the resilient plate (262). The resilient plate (262) extends through the opening of the second divider (45) orthogonal to the anchor plate (262) with a notch (263) on the far edge for clamping down the copper wires (31) of the stripped electric cable (30) to be inserted through the wire hole (46). The counter force of the resilient plate (262) will clamp down the copper wires (31) around the notch (263) and press them against the metal plate (11) of the connector (10) disposed in the plate slot (23) next to the wire hole (25).

Figure 9:
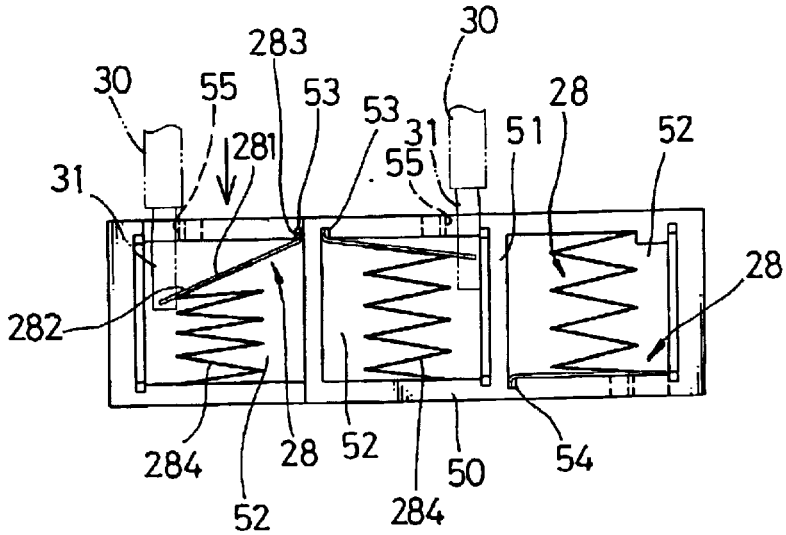
FIG. 9 is a side view of the mounting fixture in accordance with the fourth embodiment of the invention.
Figure 8:
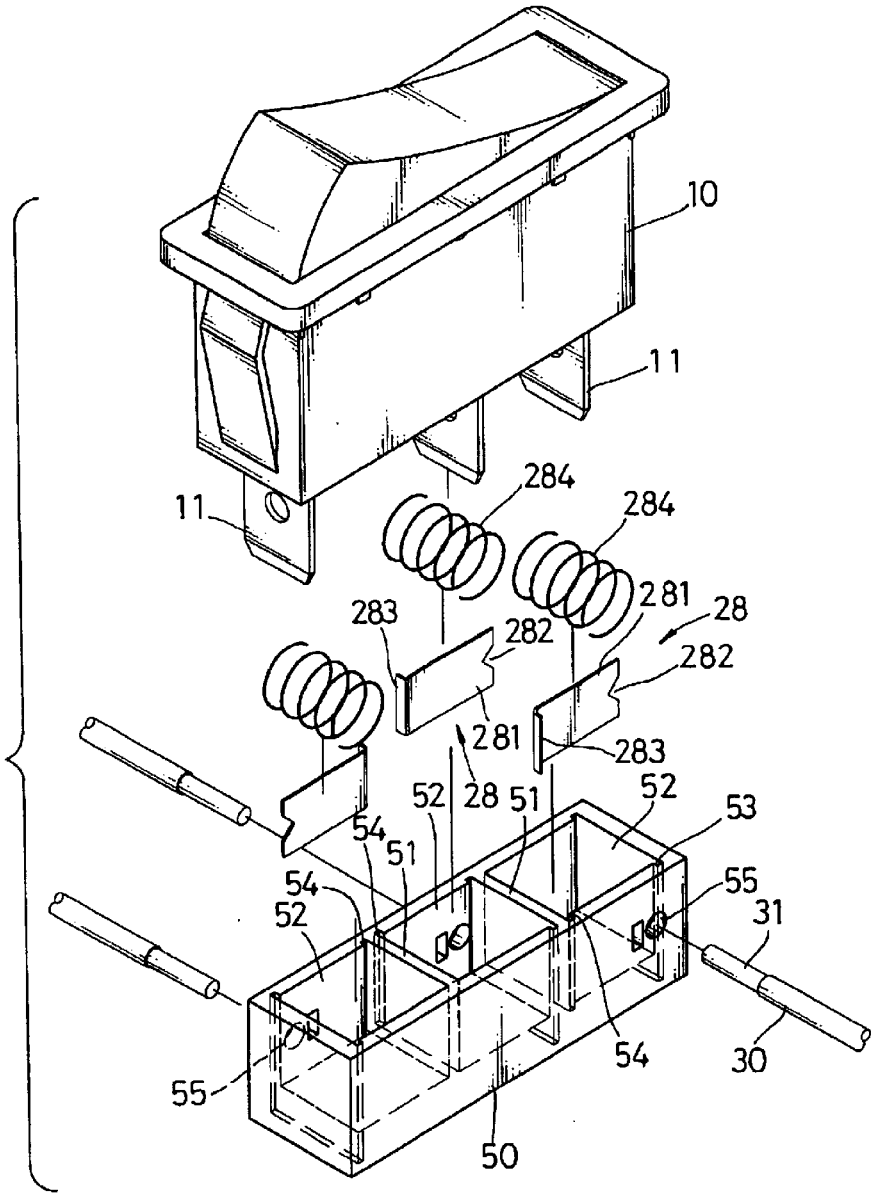
FIG. 8 is an exploded diagram of the connector assembly in accordance with the fourth embodiment of the invention.

The structure and assembly of the connector in accordance with the fourth embodiment of the invention are shown in FIGS. 8, 9. The housing (50) is formed like an open box with a plurality of compartments (52) separated by dividers (51). Each compartment (52) securely receives a metal inlay (28) for clamping down copper wires (31) of the stripped electric cable (30) to be inserted from outside.

A plate slot (53) is formed adjacent to one end wall of the compartment (52) for receiving the metal plate (11) of the connectors (10), and an anchor slot (54) is defined adjacent to the opposite end wall. The compartment (52) also has a wire hole (55) passing through the side wall of the housing (50) for receiving copper wires (31) to be inserted from outside. The metal inlay (28) is aligned with the wire hole (55) such that the axis running through the opening of the wire hole (55) is orthogonal to the plane of the resilient plate *(281).

The main distinction of the fourth embodiment relative to the three previously described implementations lies in the metal inlay (28). In the fourth embodiment, the metal inlay (28) is formed by a resilient plate (281) and a spring (284). The resilient plate (281) has a notch (282) on the far edge, but the opposite end is bent to form a hooked section (283), which is inserted into the anchor slot (54) for positioning. The notch (282) on the far edge of the resilient plate (281) is able to overlap part of the opening of the wire hole (55), and the spring (284) is installed underneath the resilient plate (281) inside the compartment. (52). When the copper wires (31) of the stripped electric cable (30) are inserted through the wire holes (55), the copper wire (31) nudges against the resilient plate (282) and in turn exert a pressure on the spring (284) underneath, creating a counter force. When the incoming pressure is released, the resilient plate will spring back and clamp on the copper wires (31) around the notch (282) to hold the wires in place and push them towards the metal plate (11) of the connector (10) without any risk of the wires escaping the housing (20).

Figure 10:
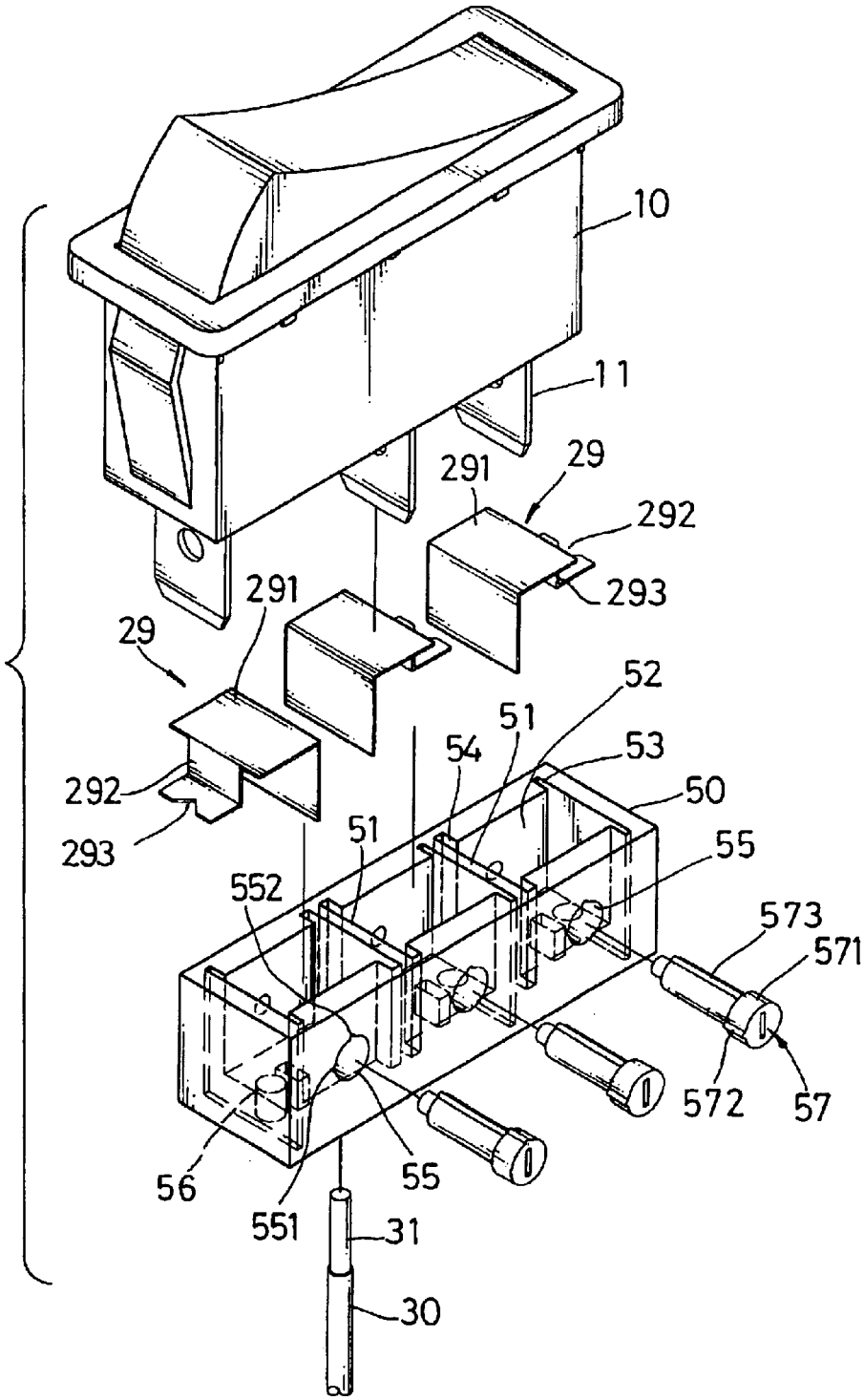
FIG. 10 is an exploded view of the assembly of the connector in accordance with the fifth embodiment of the invention.
Figure 11:
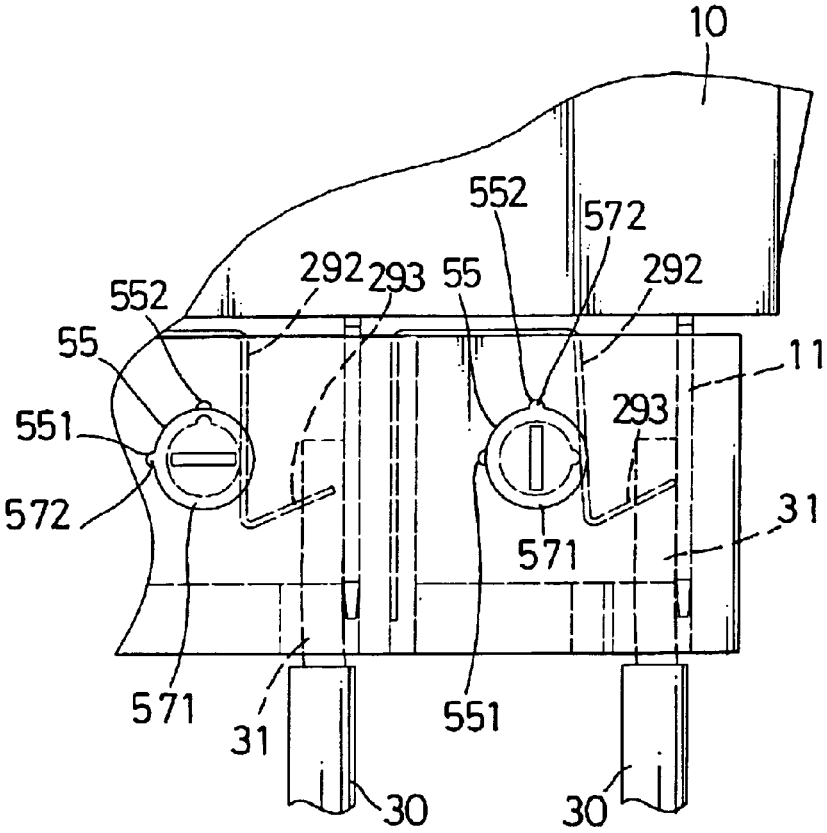
FIG. 11 is a side view of the part of the mounting fixture in accordance with the fifth embodiment of the invention.

The structure and assembly of the connector in accordance with the fifth embodiment of the invention are shown in FIGS. 10, 11. The housing (50) is formed as an open box with a plurality of compartments (52) separated by dividers (51). Each compartment (52) securely receives a metal inlay (29) for clamping down copper wires (31) of a stripped portion of the electric cable (30) to be inserted from outside.

A pin slot (53) is formed adjacent to one end wall of the compartment (52) for receiving the metal plate (11) of the connector (10), and an anchor slot (54) is defined adjacent to the opposite end wall. The compartment (52) has a wire hole (55) passing through the bottom of the compartment (52), and a second hole (56) through the lateral sidewall of the compartment (52). It should be noted that there are two cuts (551) (552) in the periphery defining the second hole (56).

The metal inlay (29) is press-formed having three right-angle bends producing an anchor plate (291) and a resilient plate (292) on two opposite sides. The width of the anchor plate (291) is greater than that of the resilient plate (292). The resilient plate (292) has a notch (293) in the far edge, and the anchor plate (291) has a downward-pointing arm for insertion into the anchor slot (54) to position the resilient plate (292). The metal inlay (29) is placed into the compartment (22), such that the bent section (not numbered) is disposed along the axis running through the second hole (56).

A locking pin (57) made from extensible material has a ridge (572) formed over a head portion (571) oriented longitudinally. An extension portion (573) has a pusher mechanism. When the locking pin (57) is inserted through the second hole (56) into the compartment (52), the head portion (571) corresponds with the inner surface defining the second hole (56), and the ridge (572) is fitted against one cut (551)(552) for positioning. Since the locking pin (57) is made from extensible material with good flexibility, and the insertion of the locking pin (57) causes friction between the surface of the head portion (571) and the inner surface of the second hole (56), the ridge (572) will be lodged in one of the two cuts (551) (552) to prevent loosening of the locking pin (57).

As shown in FIG. 11, when the ridge (572) of the locking pin (57) is lodged in the first cut (551) of the second hole (56), the extension section (573) is not in contact with the resilient plate (292). The copper wires (31) of the stripped portion of the electric cable (30) can be inserted through the bottom hole (56) of the housing (50), and at this point the ridge (572) over the head portion of the locking pin (57) is shifted from the first cut (551) to the second cut (552), and the extension section (573) carrying the pusher will press against the resilient plate (292) forcing it to clamp on the copper wires (31) around the notch (293). Thus the copper wires (31) can be held in place and pushed towards the metal pin (11) of the switch (10) to create the necessary electrical connection, without any risks of the copper wires (31) escaping.

The point of emphasis throughout all implementations of the present invention, except the fifth implementation, is that the mechanical design of the metal inlay in the mounting fixture employs the counter force of the resilient plate on one end to clamp on the copper wires of the stripped portion of the electric cable for making the necessary electrical connection, while the other end of the metal inlay is firmly anchored in the housing. The fifth implementation employs a locking pin with a pusher mechanism. These designs enable fast installation of the connector with no need of tools or soldering, thus improving productivity in the connector assembly.

The foregoing description of the preferred embodiments of the present invention is intended to be illustrative only and, under no circumstances, should the scope of the present invention be so restricted.

What is claimed is:

1. A mounting fixture for switch connectors comprising:

a housing with a plurality of first dividers separating an interior of the housing into a plurality of compartments wherein each compartment has two pairs of opposed side walls and a bottom wall extending between the pairs of side walls, a plate slot adjacent to a first of the side walls and an anchor slot adjacent to a second side wall opposed to the first side wall, and each compartment has a wire hole defined through the bottom wall of the housing, and a second divider to strengthen the position of the adjacent anchor slot; and a plurality of metal inlays respectively received in the plurality of compartments and having an anchor plate formed on one side and a resilient plate formed on another side, wherein the resilient plate in each compartment can be more than one to form multiple prongs and the resilient plate is formed orthogonal to a longitudinal axis of the wire hole.

2. The mounting fixture for switch connectors as claimed in claim 1, wherein the metal inlay is press-formed with two planes orthogonal to each other and forming respectively the anchor plate and the resilient plate, wherein the anchor plate is wider than the resilient plate, and the resilient plate has a notch defined in a distal edge and partially overlapping the wire hole, such that when copper wires protruding from a sheath portion of the electric cable are inserted respectively through the wire holes, the notch of the resilient plates clamp on the copper wires to hold the copper wires in place.

3. The mounting fixture for switch connectors as claimed in claim 1, wherein the metal inlay can be formed by a resilient plate and a spring, wherein the resilient plate has a notch on a distal edge of one end, and a hooked section is formed on another end for insertion into the anchor slot, and the spring can be installed underneath the surface of the resilient plate.

4. The mounting fixture for switch connectors as claimed in claim 1, wherein a second hole is defined through one of the side walls of the respective compartment, and each metal inlay is formed with a bent section having three right-angle bends, and a locking pin is formed from extensible material and having a head section and an extension section having a pusher mechanism.

5. The mounting fixture for switch connectors as claimed in claim 4, wherein the second hole has two cuts defined in a periphery of the second hole, and the locking pin has a longitudinal ridge on an external surface of the head section, such that when the locking pin is inserted through the second hole into the compartment, the head section corresponds with an inner surface defining the second hole, wherein the ridge is received in a respective one of the two cuts for postponing.

* * * * *